US006568643B2

(12) United States Patent
Black

(10) Patent No.: US 6,568,643 B2
(45) Date of Patent: May 27, 2003

(54) ADJUSTABLE BOTTLE HOLDER

(76) Inventor: Patrick T Black, 6 Brookside Dr., Huntington, NY (US) 11743

( * ) Notice: Subject to any disclaimer, the term of this patent is extended or adjusted under 35 U.S.C. 154(b) by 0 days.

(21) Appl. No.: 10/059,876

(22) Filed: Jan. 29, 2002

(65) Prior Publication Data

US 2002/0166926 A1 Nov. 14, 2002

Related U.S. Application Data

(60) Provisional application No. 60/289,945, filed on May 9, 2001.

(51) Int. Cl.[7] ..... A47D 15/00; A61J 9/06

(52) U.S. Cl. ..... 248/105; 248/102; 248/106

(58) Field of Search ..... 248/102, 105, 248/106, 125.1, 205.5, 123.11, 125.8, 180.1

(56) References Cited

U.S. PATENT DOCUMENTS 2,412,426 A * 12/1946 Rayko ..... 248/105
2,470,694 A * 5/1949 Foo ..... 248/1
2,881,999 A * 4/1959 Mitchell ..... 248/106
2,912,200 A * 11/1959 Reinhorn ..... 248/103
2,989,278 A * 6/1961 Hyman
4,156,391 A * 5/1979 Ubezio ..... 108/136
4,458,870 A * 7/1984 Duncan ..... 248/279
4,706,915 A * 11/1987 Cincric ..... 248/122
4,869,381 A * 9/1989 Agner ..... 215/11.1
5,098,049 A * 3/1992 van Vlaardingen ..... 248/123.1
6,073,788 A * 6/2000 Stroud ..... 215/11.1
6,343,807 B1 * 2/2002 Rathbun ..... 280/276

* cited by examiner

*Primary Examiner*—Anita King
*Assistant Examiner*—Amy J. Sterling
(74) *Attorney, Agent, or Firm*—Michael I. Kroll

(57) ABSTRACT

A device positions a bottle close to the user's mouth, while automatically returning the bottle to a more upright position when released by the mouth. The device attaches to a horizontal surface such as a high chair tray and uses a spring mechanism for the automatic return. The height is adjustable.

10 Claims, 10 Drawing Sheets

ADJUSTABLE BOTTLE HOLDER

This application is subject to U.S. provisional application serial No. 60/289,945, filed May 9, 2001 and please incorporate by reference all information in referenced provisional application into this instant application.

BACKGROUND OF THE INVENTION

Field of the Invention

The present invention relates generally to bottle holders and, more specifically, to a bottle holding device that can be placed onto a surface within reach of an intended user and adjusted to a comfortable position for the user consuming the contents contained within the bottle without the aid or assistance of another individual, and without having the bottle in a position such that the contents will be expelled from the bottle when not in use or undesired by the user.

While there are other bottle holding devices that may be suitable for the purposes for which they were designed, such devices would not be as suitable for the purposes of the present invention, as hereinafter described. What is needed is an adjustable bottle holder that positions a bottle such that the user, such as a small child, can place his or her mouth on the bottle opening, such as a nipple, while the bottle is downwardly pointed, and which also automatically positions the bottle in a substantially horizontal or upwardly pointed direction when the bottle opening is released by the mouth.

SUMMARY OF THE PRESENT INVENTION

A primary object of the present invention is to provide a bottle holding device that can be placed onto a surface within reach of an intended user and adjusted to a comfortable position for the user who desires to consume the contents contained within the bottle without the aid or assistance of another individual.

Another object of the present invention is to provide a bottle holding device that is adjusted to a comfortable position without having the bottle in a position such that the contents thereof will be expelled from the bottle when not in use or undesired by the user.

Still yet another object of the present invention is to provide a bottle holding device intended for toddlers or people that are bedridden.

Yet another object of the present invention is to provide a bottle holding device with a telescoping housing for height adjustment.

Additional objects of the present invention will appear as the description proceeds.

The present invention overcomes the shortcomings of the prior art by providing a bottle holding device that can be fixed onto a surface within reach of an intended user, such as a small child, and adjusted to a comfortable position for the user who desires to consume the contents contained within the bottle without the aid or assistance of another individual, and without having the bottle in a position such that the contents thereof will be expelled from the bottle when not in use or undesired by the user. The bottle holder of the present invention is intended for toddlers or people that are bed ridden and has a holding mechanism to hold a bottle containing a consumable liquid. The bottle holder is adjustable and has a return mechanism spring to return the bottle holder to a preset position so that the contents of the bottle are not expelled. The device includes a telescoping mechanism that adjusts the device in a controlled up and down motion, locking at a position desirable to the user.

My invention provides a device for positioning a bottle on a horizontal surface, the bottle having a mouthpiece for user consumption of liquid contents, comprising: a base, the base being fixable to the surface; a first stand member and a second stand member, the stand members telescoping between at least two fixed positions, the first stand member being fixed to the base; a bottle support assembly having a platform for supporting the bottle, and a fastener for securing the bottle to the platform, the support assembly being hingedly fixed to the second stand member, and a spring positioned in cooperating relationship with the second stand member and the bottle support assembly, such that the spring biases the support assembly to a first position, the support assembly being hingedly movable to a second position upon loading the spring, the bottle mouthpiece being lower in the support assembly second position than the first.

In one embodiment, the first stand member has a hole and a height adjustment member, the height adjustment member having a stud, and further wherein the second stand member has a plurality of holes, each hole aligning, in turn, with the first stand member hole as the first and second stand members telescope, each hole being sized to receive the height adjustment member stud when aligned with the first stand member hole, the height adjustment member being resiliently bendable to remove the stud from the first stand member hole and the second stand member hole.

In one embodiment, the mouthpiece is a nipple.

In one embodiment, the bottle is curved along its longitudinal axis.

In one embodiment, the spring is a coiled spring, the coiled spring being wound as the bottle support assembly is moved to the second position.

In one embodiment, the spring is a cylindrical helical spring, the spring being loaded into compression as the bottle support assembly is moved to the second position.

In one embodiment, the first stand member is fixed to the base at an acute angle to the surface.

In one embodiment, the first stand member is fixed to the base at a substantially vertical angle.

In one embodiment, the base is deformable and creates a suction attachment to the surface when the base is deformably compressed against the surface.

In one embodiment, the bottle support assembly, when in the first position, is in an upward orientation with respect to the horizontal surface, the orientation being above the horizontal and less than or equal to the vertical.

There is provided a device for positioning a bottle on a horizontal surface, the bottle having a mouthpiece for user consumption of liquid contents, comprising: a base and attachment means for fixing the base to the surface; support means for supporting a bottle, the support means having fastener means for fastening the bottle to the support means; elevation means for elevating the support means above the base, the elevation means further comprising height adjustment means for adjusting the degree of elevation; rotation means for rotating the support means between a first and second position such that the mouthpiece is lower in the second position than in the first position; and spring means for automatically returning the support means from the second position to the first position.

In one embodiment, the base attachment means further comprises suction means for creating suction between the base and the horizontal surface.

My invention provides a device for positioning a bottle on a horizontal surface, the bottle having a nipple for user consumption of liquid contents, comprising: a base, the base being deformable and fixable to the surface by suction; a first stand member and a second stand member, the stand members telescoping, the first stand member being fixed to the base, the first stand member having a hole and an attached height adjustment member, the height adjustment member having a stud, and further the second stand member having a plurality of holes, each hole aligning, in turn, with the first stand member hole as the first and second stand members telescope, each hole being sized to receive the height adjustment member stud when aligned with the first stand member hole, the height adjustment member being resiliently bendable to remove the stud from the first stand member hole and the second stand member hole, the second stand member also having a bore; a bottle support assembly having a platform for supporting the bottle and a fastener for securing the bottle to the platform, the support assembly being hingedly fixed to the second stand member; and a spring positioned in the second stand member bore such that the spring bears upon the support assembly, the support assembly being biased in response to the spring to a first position, the support assembly being hingedly movable to a second position upon loading the spring, the nipple being lower in the support assembly second position than the first.

The foregoing and other objects and advantages will appear from the description to follow. In the description, reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which:

FIG. 1 an illustrative view of a prior art device. There are many ways of administering a bottle to a toddler, some hold the bottle while the toddler is feeding and some people prop the bottle up against objects such as themselves or a pile of blankets or a pillow.

FIG. 2 is an illustrative view of the present invention in use. The bottle holder of the present invention can be placed onto a surface within reach of an intended user and adjusted to a comfortable position for the user who desires to consume the contents contained in the bottle without the aid or assistance of another individual, and without having the bottle in a position such that the contents thereof will drip from the bottle when not in use or undesired by the user.

Figure 5:
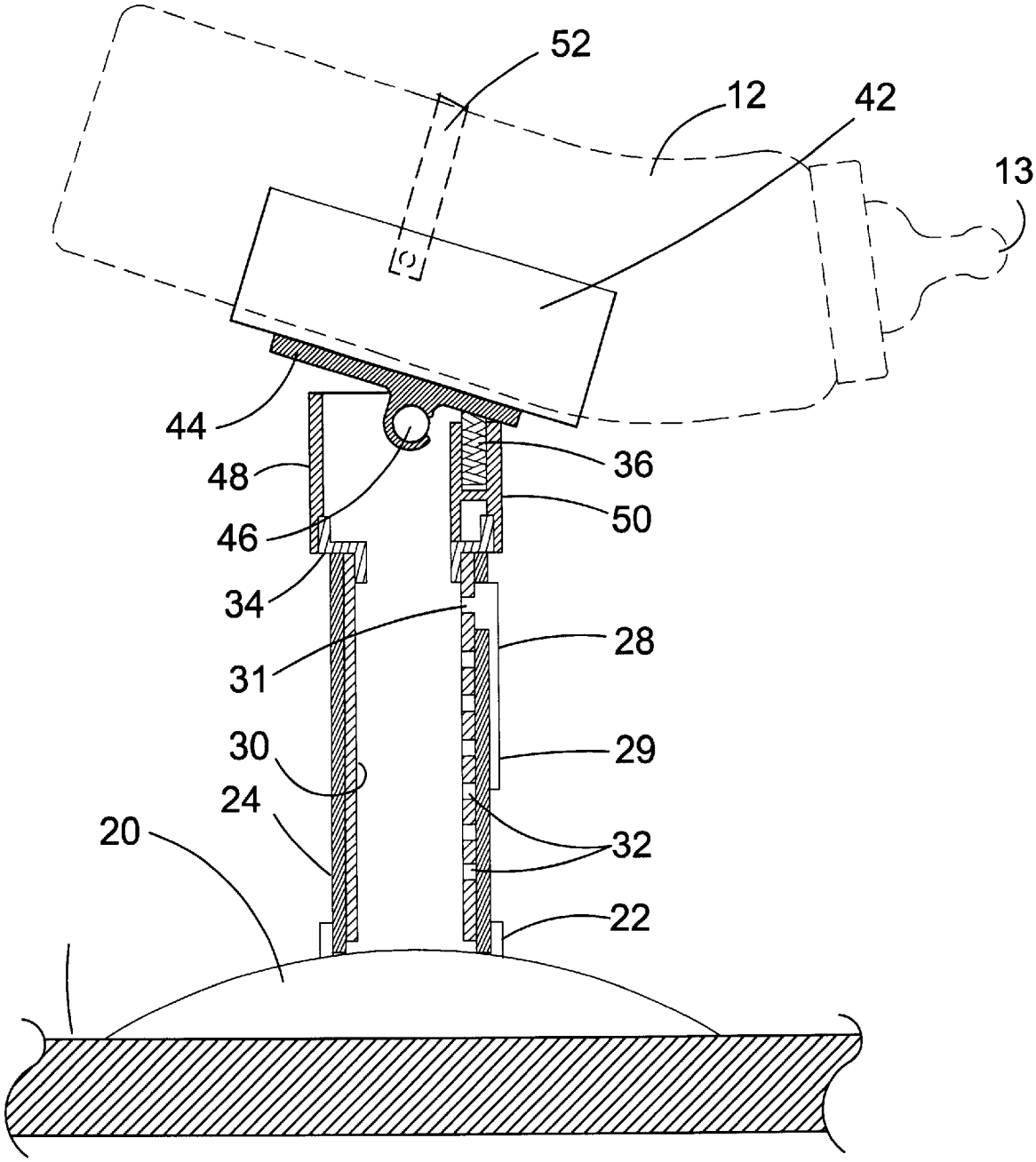

FIG. 5 is a partial sectional view of the present invention with the spring mechanism compressed. Shown is the bottle holder of the present invention in a feeding position. When the pressure is released the spring will cause the bottle to return to its starting position.

Figure 6:
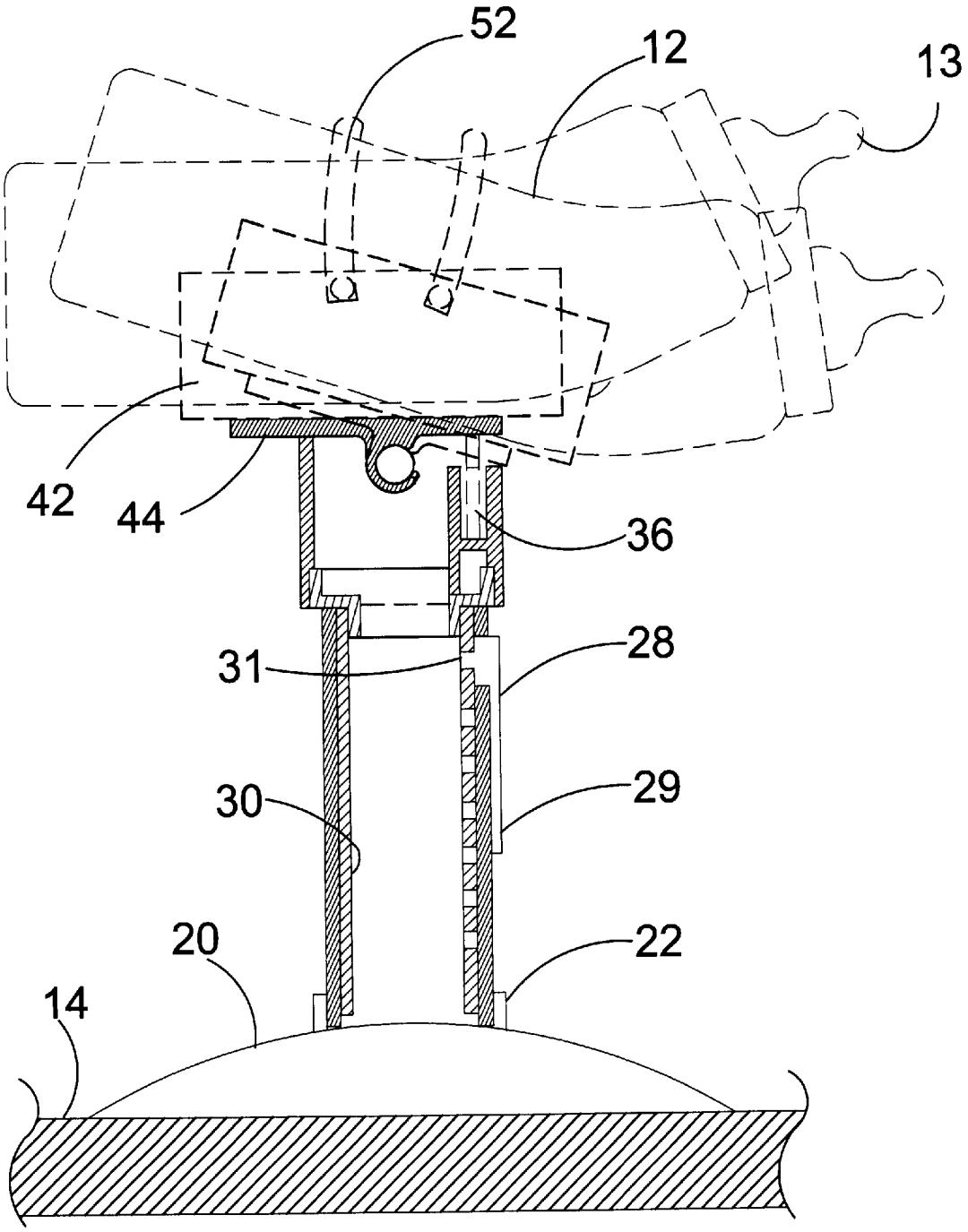

FIG. 6 is a partial sectional view of the bottle in the first and second positions.

Figure 7:
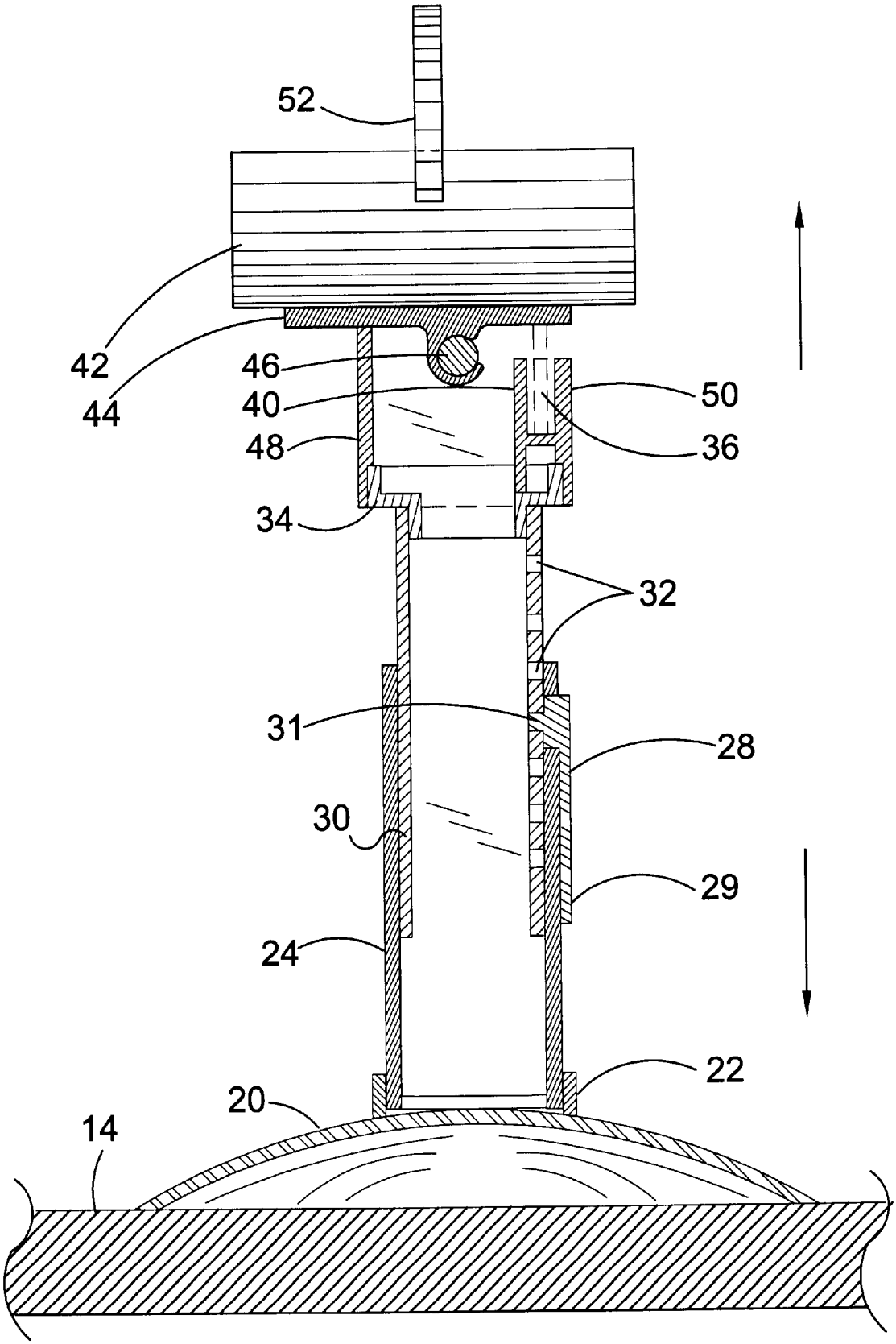

FIG. 7 is a sectional view of the present invention in a higher position, the height adjustment member stud being directed into a lower hole in the movable stand member.

Figure 3:
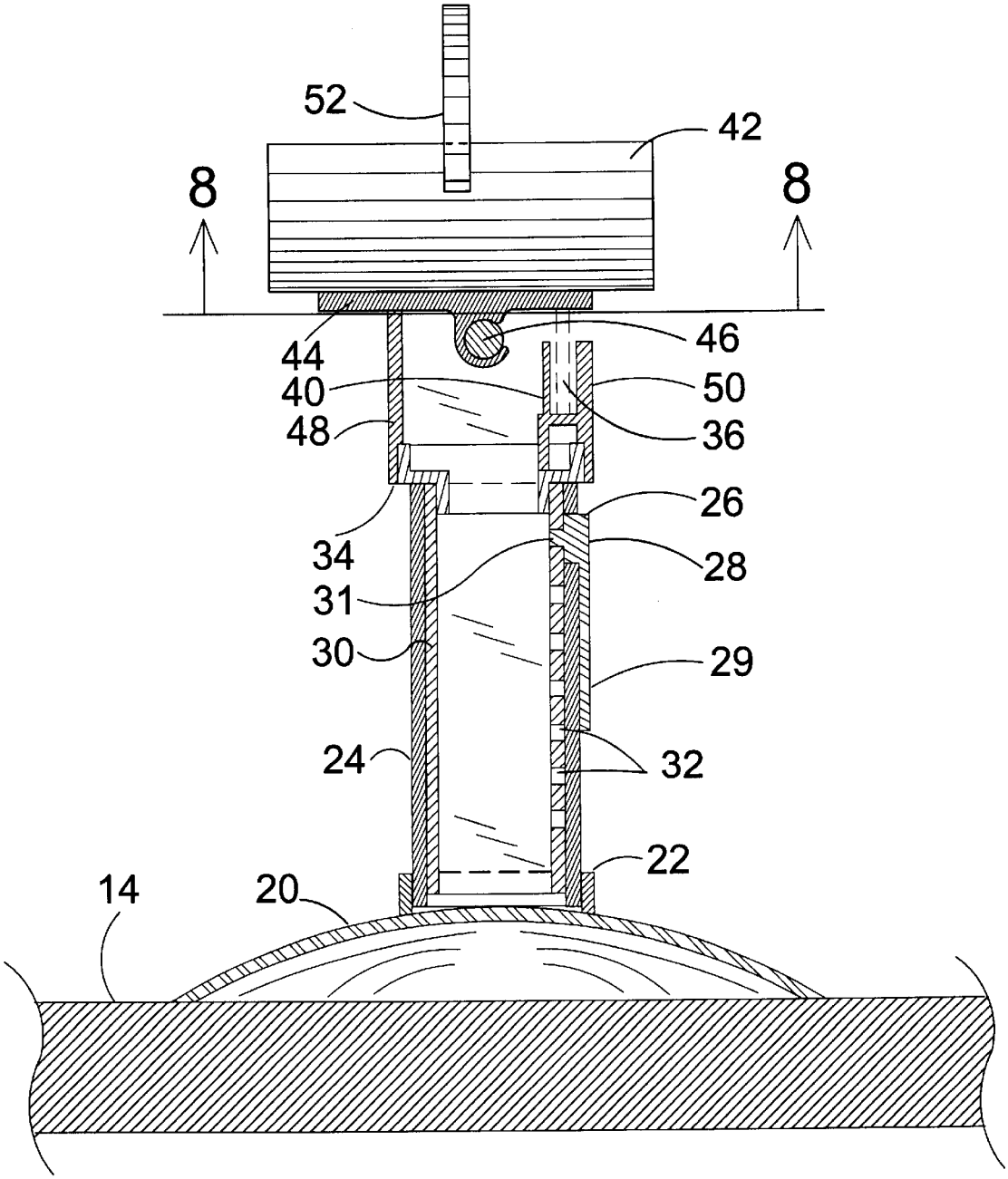
FIG. 3 is shown is a sectional side view of the present invention.
Figure 8:
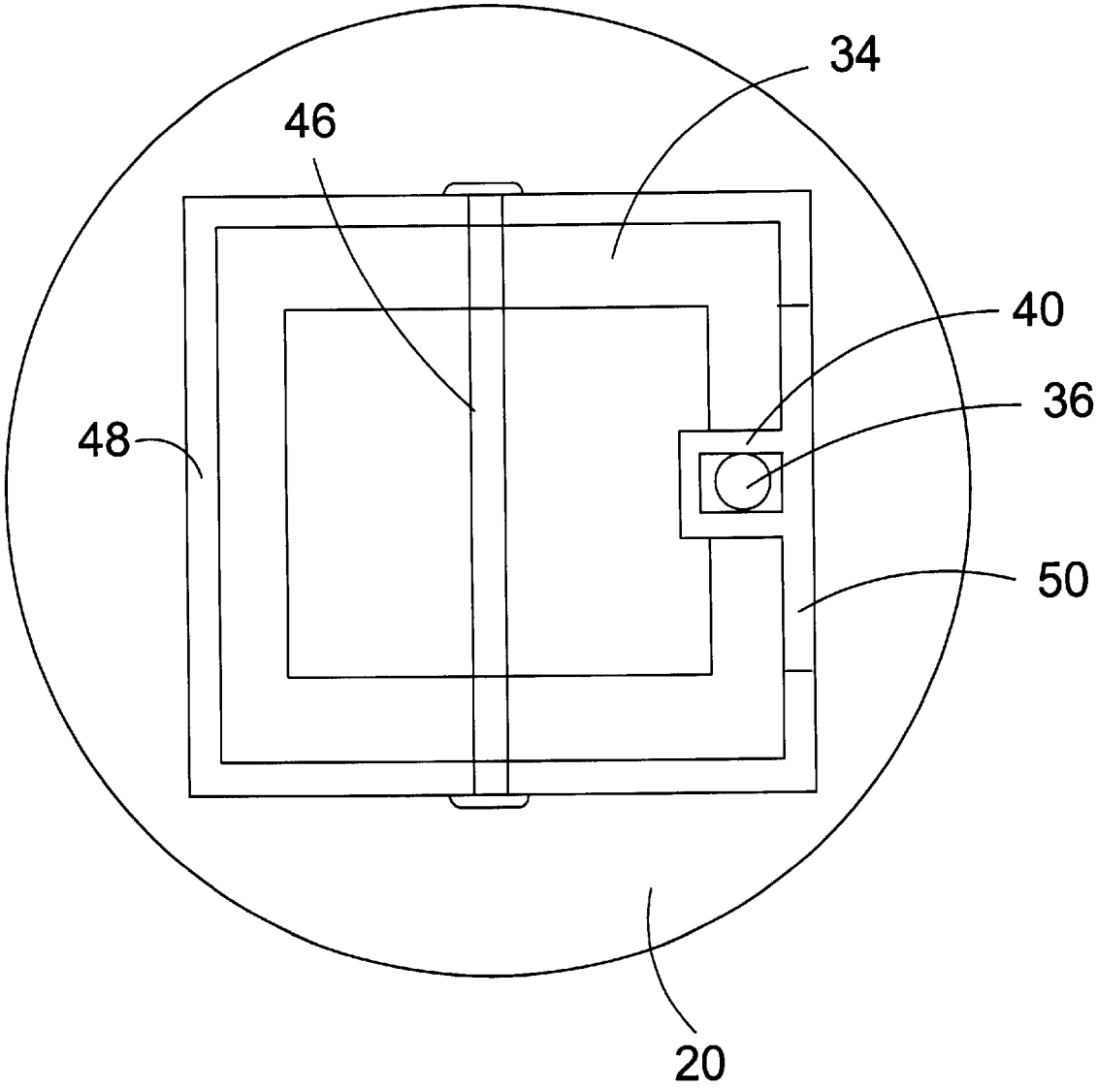

FIG. 8 is a partial sectional top view taken along cutting plane 8—8 shown on FIG. 3.

Figure 9:
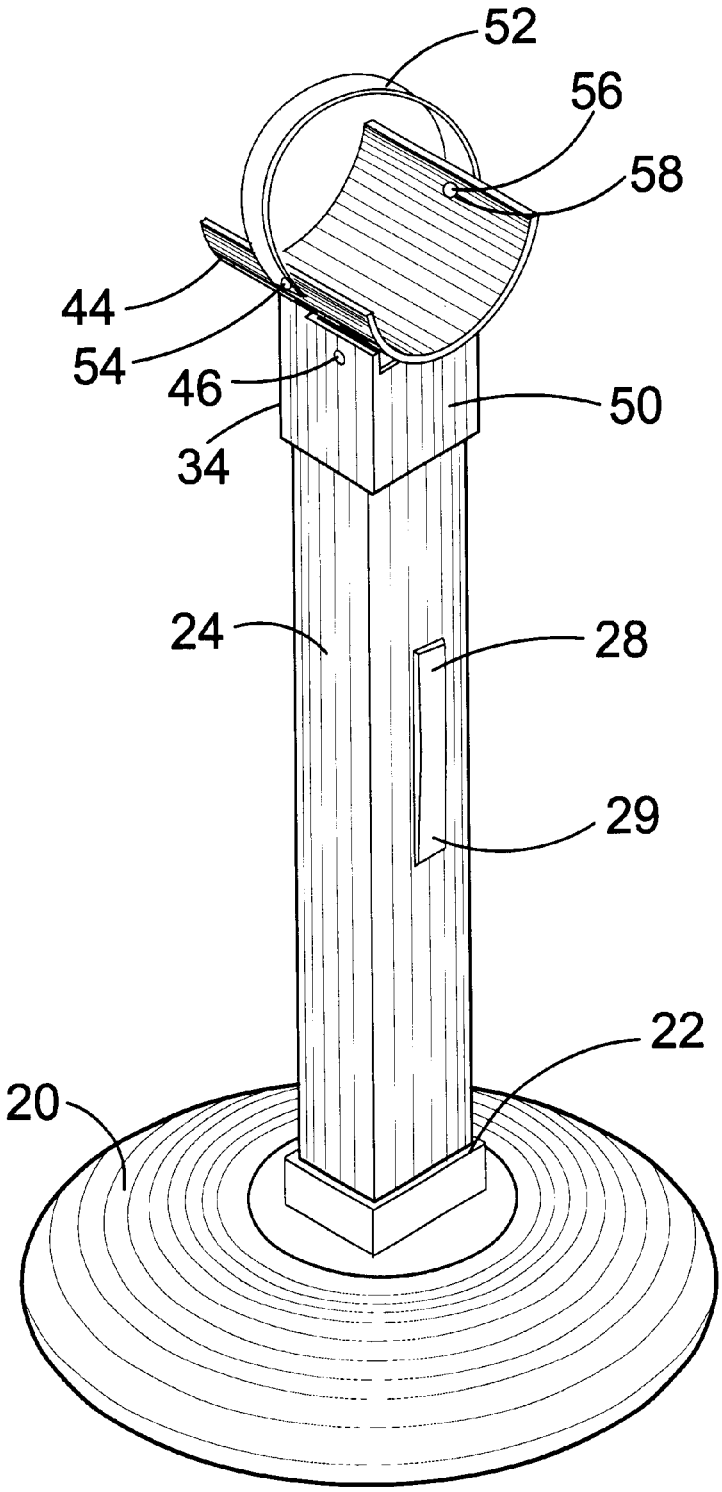

FIG. 9 is a perspective view of the device with the bottle removed and the fastener open.

Figure 10:
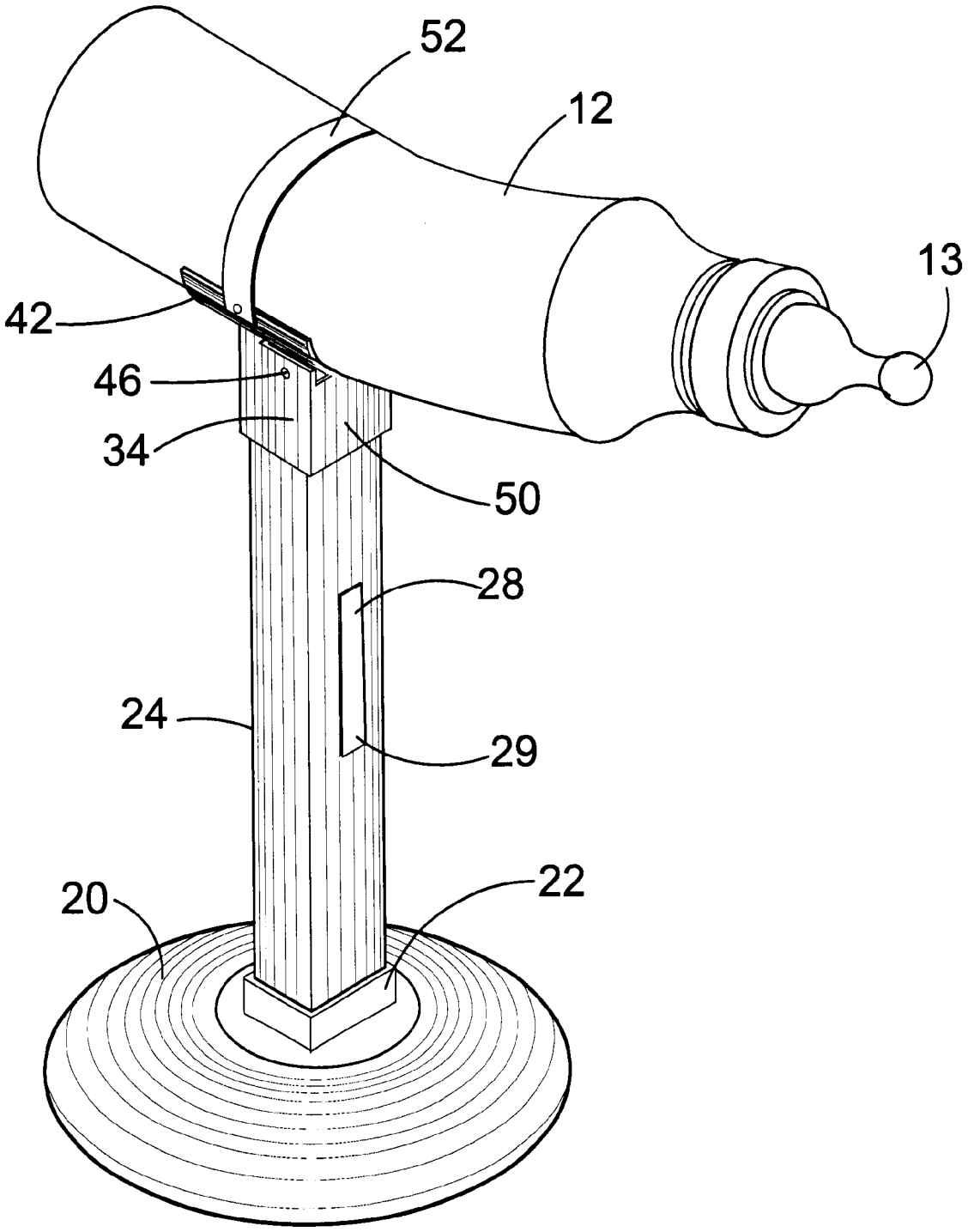

FIG. 10 is a perspective view of the device with the bottle in place.

DESCRIPTION OF THE REFERENCED NUMERALS

Turning now descriptively to the drawings, in which similar reference characters denote similar elements throughout the several views, the figures illustrate the present invention. With regard to the reference numerals used, the following numbering is used throughout the various drawing figures.

10 Bottle Holder of the present invention
11 child
12 bottle
13 bottle nipple
14 high chair tray surface
20 base
22 base platform
24 fixed stand member
26 fixed stand member hole
28 height adjustment member
29 height adjustment member lower end
30 movable stand member
31 height adjustment member adjustment stud
32 movable stand member hole
34 movable member upper portion
36 spring
40 upper portion spring bore
42 bottle holding tray
44 bottle holding tray support
46 bottle holding tray support hinge pin
48 upper portion rear wall
50 upper portion front wall
52 bottle holding tray fastener
54 bottle holding tray fastener hinged end
56 bottle holding tray fastener snap stud
58 bottle holding tray hole

DETAILED DESCRIPTION OF EXEMPLARY EMBODIMENTS OF THE INVENTION

The following discussion describes in detail exemplary embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
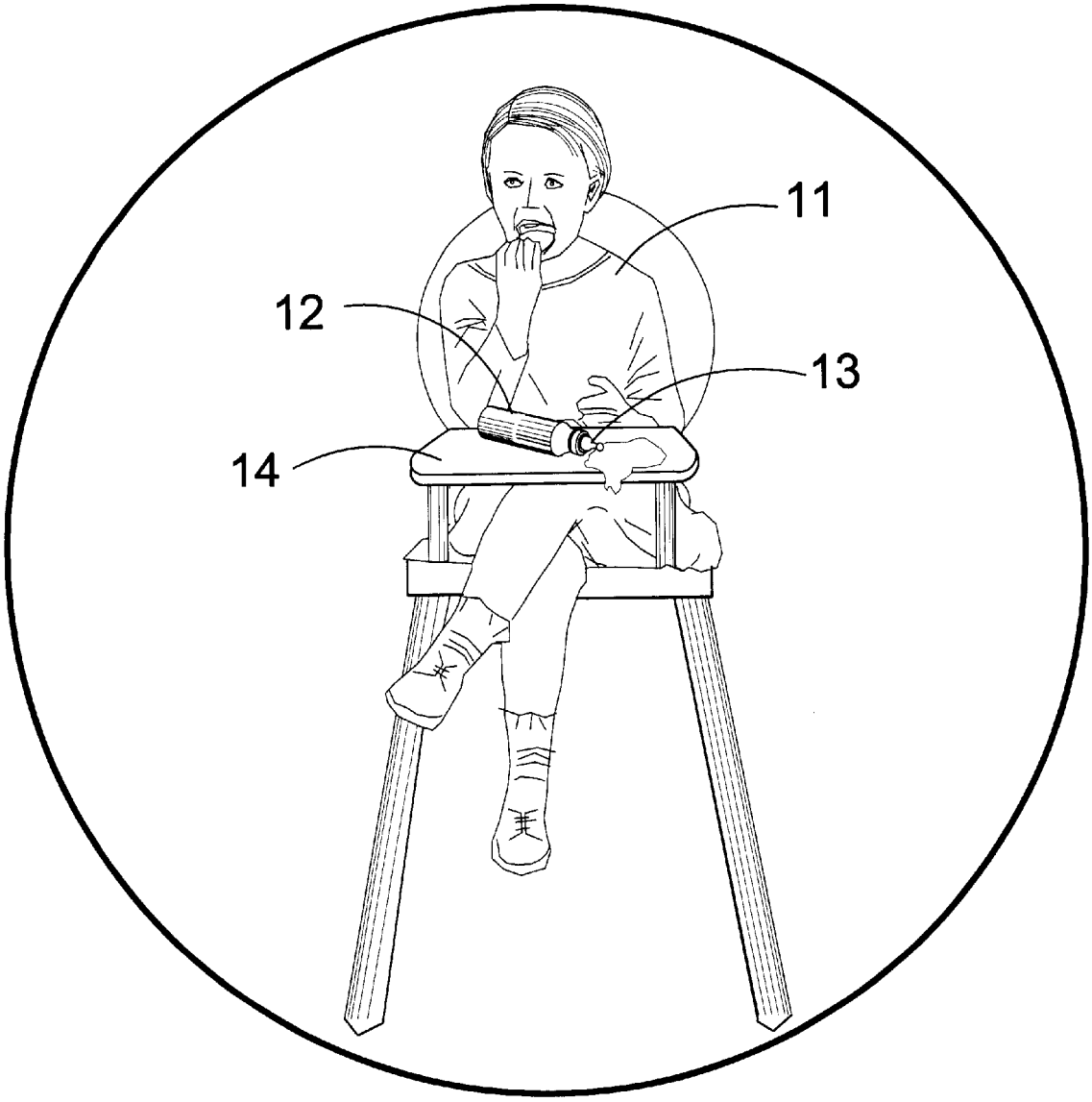
Figure 2:
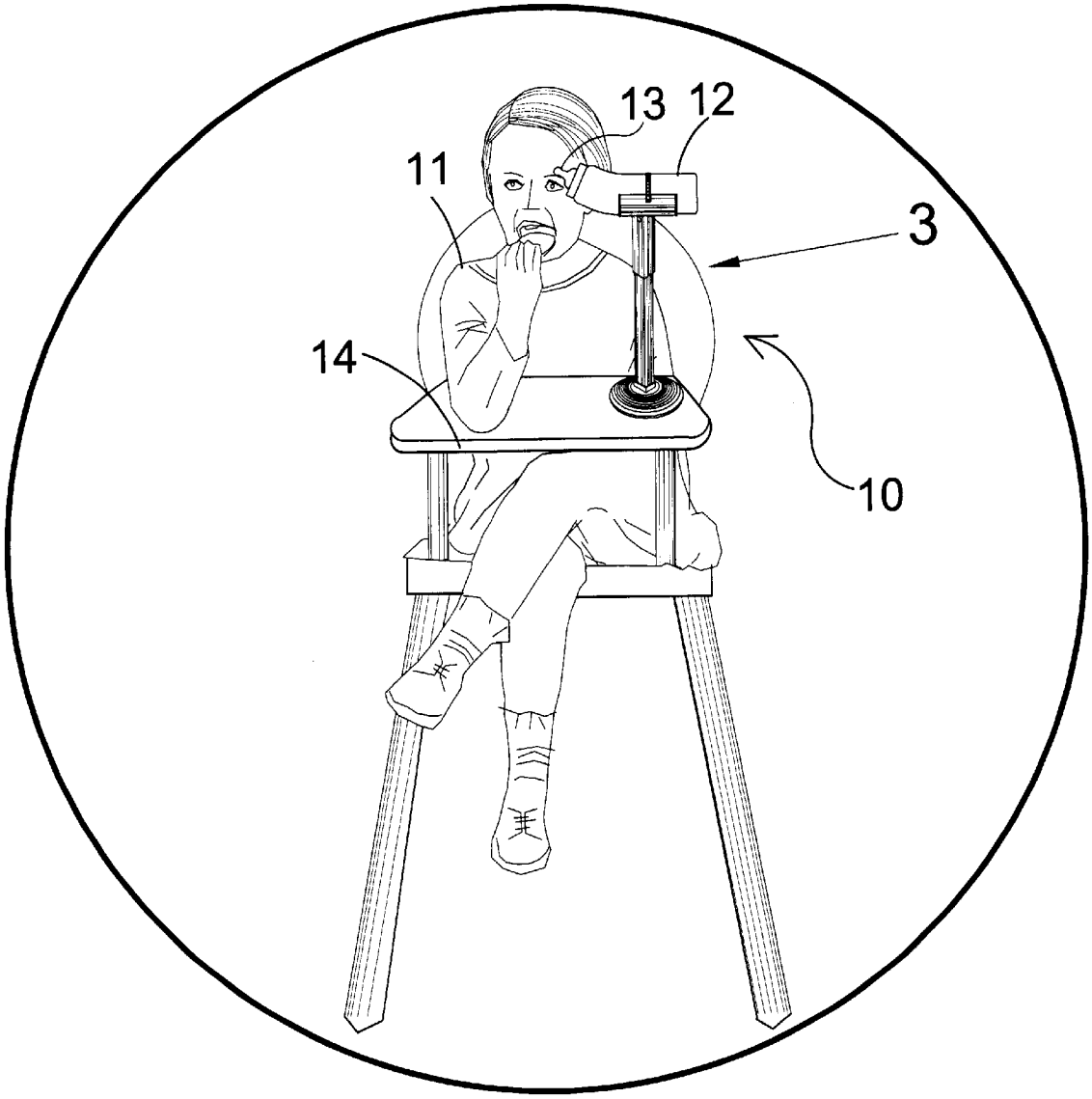

As shown in FIGS. 1, it is typical for a small child 11 to use a bottle 12 with a nipple 13, with the bottle 12 often being toppled over onto a high chair tray surface 14 with accompanying spills. FIGS. 2–9 illustrate the bottle holder 10 of the present invention, with FIG. 2 showing the holder 10 positioned on the high chair tray surface 14, using an upswept bottle 12. FIG. 3 shows that the holder 10 has a suction base 20 for fixing the holder 10 into position on the high chair tray surface 14. Extending upwardly from the base 20 is a generally square platform 22 for securing a vertically oriented, and generally square stand member 24, the stand member 24 being fixedly inserted into the platform 22. The fixed stand member 24 has a hole 26 in one side. Attached to the fixed stand member 24 is a height adjustment member 28 that is attached at a lower end 29, and has an upper end stud 31 sized to fit the fixed stand member hole 26.

Closely received by the fixed stand member 24 is a movable stand member 30, with spaced holes 32, as shown in FIG. 3. These holes 32 receive the height adjustment member stud 31. The degree to which the movable stand member 30 telescopes out of the fixed stand member 24, is determined by the movable stand member hole 32 chosen to receive the height adjustment member stud 31. A lower hole 32 will elevate the movable stand member 30 to a higher position, as shown in FIG. 7.

The movable stand member 30 spreads, in collar-like fashion, to an upper portion 34. As shown in FIG. 3, a spring 36 is positioned within a bore 40 formed within the movable stand member upper portion 34. FIG. 8 provides a top view showing the position of the bore 40.

A bottle holding tray 42, shown in FIG. 3 and FIG. 8, is cradle-shaped and is held by a support 44 that is hinged to the movable stand member upper portion 34 by hinge pin 46. The support 44 is positioned to hingedly move against an upper portion rear wall 48 and an upper portion front wall 50, the front wall 50 being shorter in height than the rear wall 48.

FIG. 8 depicts the bottle holding tray 42 and a strap-like fastener 52 having a hinged end 54 and a stud 56. The fastener 52 tightly secures the bottle 12 within the tray 42, with the fastening completed by inserting the stud 56 into a hole 58 in the bottle holding tray 42, as shown in FIG. 9.

Figure 4:
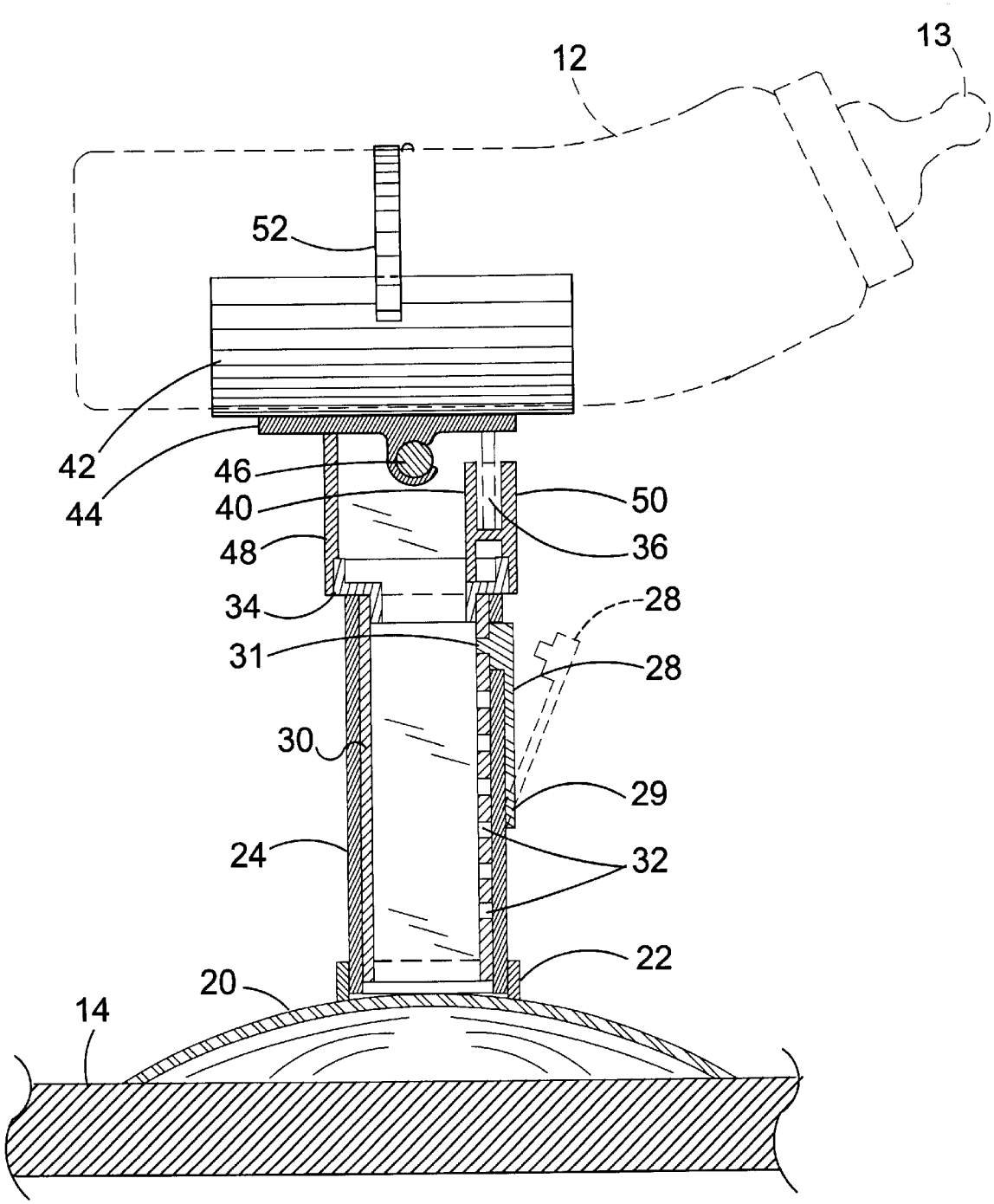
FIG. 4 is a sectional side view of the present invention with the bottle shown in broken line.

As shown in FIG. 4, the spring bore 40 positions the spring 36 in an off-centered position within the upper portion 34 and proximate the shortened front wall 50. In this position, the spring 36 is biased against the support 44, holding the support 44 substantially horizontal, and thereby holding the bottle holding tray 42 and bottle 12 in a substantially horizontal position.

The spring 36 is gauged to be readily compressible by the very young child 11, such that the child 11 can move the bottle nipple 13 into a lower position, as shown in FIG. 5. The relative positions of the bottle 12, when the spring 36 is alternately compressed and released, are shown simultaneously in FIG. 6.

In use, the parent secures the child 11 in a high chair or other seating position close to a steady surface such as that on the high chair tray. The parent then uses the suction base 20 to fix the base platform 22 and telescoping stand members 24,30 in a substantially upright position. (In other embodiments, the base platform is configured to extend the telescoping stand members 24,30 at a fixed or adjustable angle.)

Once the telescoping stand members 24,30 are fixed in the upright position, the parent bends the height adjustment member 28 and aligns the stud 31 with the movable stand member hole 32 that elevates the bottle holding tray 42 to the desired height. The parent then inserts the stud 31 into the holes 26,32 and the new telescopic position is secured.

The bottle 12 is then attached to the bottle holding tray 42 using the fastener 52. The bottle 12 can be moved along the tray 42 length prior to closing the fastener 52 to aid in positioning the bottle nipple 13 in an appropriate position with respect to the mouth of the child 11.

The child 11, or the parent, then pushes the bottle 12 down on the bottom nipple 13 end, thus compressing the spring 36 within the bore 40. The bottle holding tray support 44 rotates on hinge pin 46 and encounters the movable stand upper portion front wall 50, thus preventing the bottle nipple 13 from descending to an unacceptably low position.

While the bottle nipple 13 is in the down position, the child 11 has ready access with his or her mouth, with ordinary sucking motions being sufficient to restrain the spring 36 in the compressed position. Once the nipple 13 is released from the child's mouth the bottle 12 is moved back to the substantially horizontal position by the expansion of the spring 36. (In other embodiments, the bottle holder tray or tray support or both are configured to position the bottle to a more vertical position.)

With respect to the above description then, it is to be realized that the optimum material and dimensional relationships for the parts of the bottle holder 10, will include variations in size, materials, shape, and form, which will occur to those skilled in the art upon review of the present disclosure.

For example, the base 20, telescoping stand members 24,30, bottle holding tray 42, and tray support 44 are, in various embodiments, constructed from various woods, metals and plastics. The stand members' cross-sections are round, triangular, rectangular, or polygonal in other embodiments.

In other embodiments, the fastener 52 is made using means such as conventional hooks, snaps, clasps, hook-and-loop material, elastic strips and ties, in lieu of the hinged fastener 52. These embodiments include adjustable fasteners for variously sized bottles.

Similarly, in other embodiments, the height adjustment mechanism uses means such as a conventional rack and pinion gear combination adapted to the telescoping stand members for a larger variety of positions.

In other embodiments, the helical spring 36 is replaced with a coiled spring attached to the bottle holding tray support 44 and the movable stand member 30 such that the spring is wound as the bottle 12 is moved downward.

All equivalent relationships to those illustrated in the drawings and described in the specification are intended to be encompassed by the present invention.

What is claimed as new and desired to be protected by Letters Patent is set forth in the appended claims:

1. A device for positioning a bottle on a horizontal surface, comprising:

a bottle having a nipple for user consumption of liquid contents;

a base, the base being fixable to the surface;

a first stand member and a second stand member, the stand members telescoping between at least two fixed positions, the first stand member being fixed to the base;

a bottle support assembly having a platform for supporting the bottle, and a fastener for securing the bottle to the platform, the support assembly being hingedly fixed to the second stand member; and a spring positioned in cooperating relationship with the second stand member and the bottle support assembly, such that the spring biases the support assembly to a first position, the support assembly being hingedly movable to a second position upon loading the spring, the bottle nipple being lower in the support assembly second position than the first.

2. The device of claim 1, wherein the first stand member has a hole and a height adjustment member, the height adjustment member having a stud, and further wherein the second stand member has a plurality of holes, each hole aligning, in turn, with the first stand member hole as the first and second stand members telescope, each hole being sized to receive the height adjustment member stud when aligned with the first stand member hole, the height adjustment member being resiliently bendable to remove the stud from the first stand member hole and the second stand member hole.

3. The device of claim 1, wherein the spring is a coiled spring, the coiled spring being wound as the bottle support assembly is moved to the second position.

4. The device of claim 1, wherein the spring is a cylindrical helical spring, the spring being loaded into compression as the bottle support assembly is moved to the second position.

5. The device of claim 1, wherein the first stand member is fixed to the base at an acute angle to the surface.

6. The device of claim 1, wherein the first stand member is fixed to the base and is substantially vertical.

7. The device of claim 1, wherein the bottle support assembly, when in the first position, is in an upward orientation with respect to the horizontal surface, the orientation being above the horizontal and less than or equal to the vertical.

8. A device for positioning a bottle on a horizontal surface, comprising:

a bottle having a nipple for user consumption of liquid contents;

a base, the base being deformable and fixable to the surface by suction;

a first stand member and a second stand member, the stand members telescoping, the first stand member being fixed to the base, the first stand member having a hole and an attached height adjustment member, the height adjustment member having a stud, and further the second stand member having a plurality of holes, each hole aligning, in turn, with the first stand member hole as the first and second stand members telescope, each hole being sized to receive the height adjustment member stud when aligned with the first stand member hole, the height adjustment member being resiliently bendable to remove the stud from the first stand member hole and the second stand member hole, the second stand member also having a bore;

a bottle support assembly having a platform for supporting the bottle and a fastener for securing the bottle to the platform, the support assembly being hingedly fixed to the second stand member; and a spring positioned in the second stand member bore such that the spring bears upon the support assembly, the support assembly being biased in response to the spring to a first position, the support assembly being hingedly movable to a second position upon loading the spring, the nipple being lower in the support assembly second position than the first.

9. A device for positioning a bottle on a horizontal surface, comprising:

a bottle being curved along its longitudinal axis and having a mouthpiece for user consumption of liquid contents;

a base, the base being fixable to the surface;

a first stand member and a second stand member, the stand members telescoping between at least two fixed positions, the first stand member being fixed to the base;

a bottle support assembly having a platform for supporting the bottle, and a fastener for securing the bottle to the platform, the support assembly being hingedly fixed to the second stand member; and a spring positioned in cooperating relationship with the second stand member and the bottle support assembly, such that the spring biases the support assembly to a first position, the support assembly being hingedly movable to a second position upon loading the spring, the bottle mouthpiece being lower in the support assembly second position than the first.

10. A device for positioning a bottle on a horizontal surface, comprising:

a bottle having a mouthpiece for user consumption of liquid contents;

a deformable base which creates a suction attachment to the surface when the base is deformably compressed against the surface, the base being fixable to the surface;

a first stand member and a second stand member, the stand members telescoping between at least two fixed positions, the first stand member being fixed to the base;

a bottle support assembly having a platform for supporting the bottle, and a fastener for securing the bottle to the platform, the support assembly being hingedly fixed to the second stand member; and a spring positioned in cooperating relationship with the second stand member and the bottle support assembly, such that the spring biases the support assembly to a first position, the support assembly being hingedly movable to a second position upon loading the spring, the bottle mouthpiece being lower in the support assembly second position than the first.

* * * * *